United States Patent [19]

Patterson, Jr.

[11] Patent Number: 5,029,056

[45] Date of Patent: Jul. 2, 1991

[54] LAMP ASSEMBLY

[75] Inventor: Charles A. Patterson, Jr., McDonald, Ohio

[73] Assignee: General Motors Corporation, Detroit, Mich.

[21] Appl. No.: 386,165

[22] Filed: Jul. 28, 1989

[51] Int. Cl.[5] ..... H01R 33/965

[52] U.S. Cl. ..... 362/226; 362/267; 362/457; 439/230

[58] Field of Search ..... 362/217, 226, 267, 376, 362/377, 378, 457, 458; 439/230

[56] References Cited

U.S. PATENT DOCUMENTS

| | | | |
|---|---|---|---|
| 2,774,947 | 12/1956 | Frensch | 362/217 |
| 3,818,215 | 6/1974 | Schmidt et al. | 362/226 |
| 4,842,535 | 6/1985 | Velke, Sr. et al. | 362/217 |

FOREIGN PATENT DOCUMENTS

| | | | |
|---|---|---|---|
| 0090325 | 10/1958 | Netherlands | 439/230 |

*Primary Examiner*—Ira S. Lazarus
*Assistant Examiner*—Sue Hagarman
*Attorney, Agent, or Firm*—Edward J. Biskup

[57] ABSTRACT

A lamp assembly that includes a sleeve-like seal carried by the socket member that provides a bulb to socket terminal seal as well as a seal between the socket member and the lamp housing.

5 Claims, 2 Drawing Sheets

LAMP ASSEMBLY

This invention concerns lamp assemblies in general and more particularly relates to a lamp assembly having a socket member which carries a seal member for sealing both the interior of the lamp housing and the open end of the lamp socket from the intrusion of moisture and dust.

More specifically, the lamp assembly according to the present invention includes a socket member having an open end mountable within the socket opening formed in the rear end of a lamp housing. A lamp bulb is supported by the open end of the socket member and is located together with the front end of the socket member in the socket opening of the lamp housing. An elastomeric seal member is carried by the front end of the socket member and has a sleeve-like body portion one part of which extends radially outwardly for providing a seal between the socket member and the socket opening. Another part of the body portion has a part which extends radially inwardly at the sealing engagement with the lamp bulb so as to provide a seal between the lamp bulb and the open end of the socket member.

The objects of the present invention are to provide a new and improved lamp assembly having a socket member which carries a seal member that seals the socket opening of the lamp housing and also seals the receptacle end of the socket member from moisture and dust; to provide a new and improved lamp assembly that includes a sleeve-like seal carried by the socket member that provides a bulb to socket terminal seal as well as a seal between the socket member and the lamp housing; to provide a new and improved lamp assembly which includes a seal formed as a separate piece and mountable on the socket member which provides sealing characteristics between the lamp bulb and the socket member and between the socket member and the lamp housing; and to provide a new and improved lamp assembly in which the lamp socket serves to seal the lamp housing from moisture and dirt and contains a self-sealing arrangement for the lamp bulb electrical terminals in the socket member.

A patent which discloses a lamp socket having certain structural similarities to the present invention is U.S. Pat. No. 4,758,181 issued on July 19, 1988. In that case, the socket member carries a sealing ring having a pair of axially spaced annular ribs which serve to seal a socket opening in a lamp housing when the socket member is mated to the housing.

Other objects and advantages of the present invention will be more apparent from the following detailed description when taken with the drawings in which.

Figure 1:
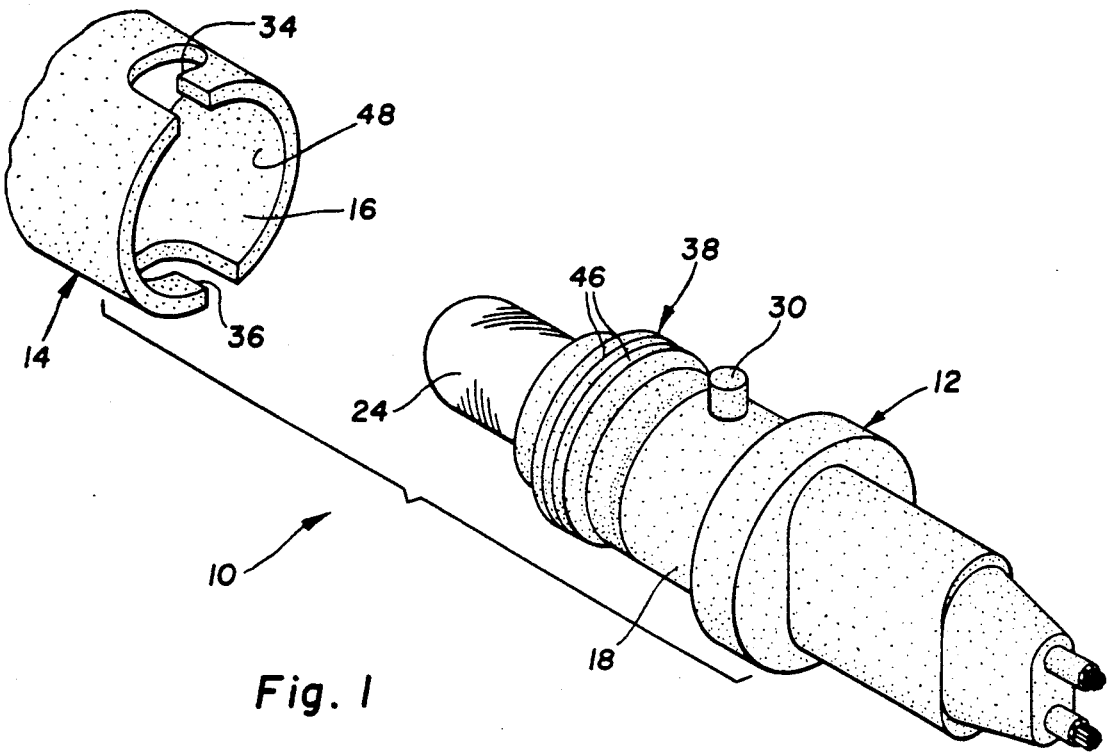
FIG. 1 is a perspective view of a lamp assembly according to the present invention with the socket member removed from the socket opening of a lamp housing.
Figure 2:
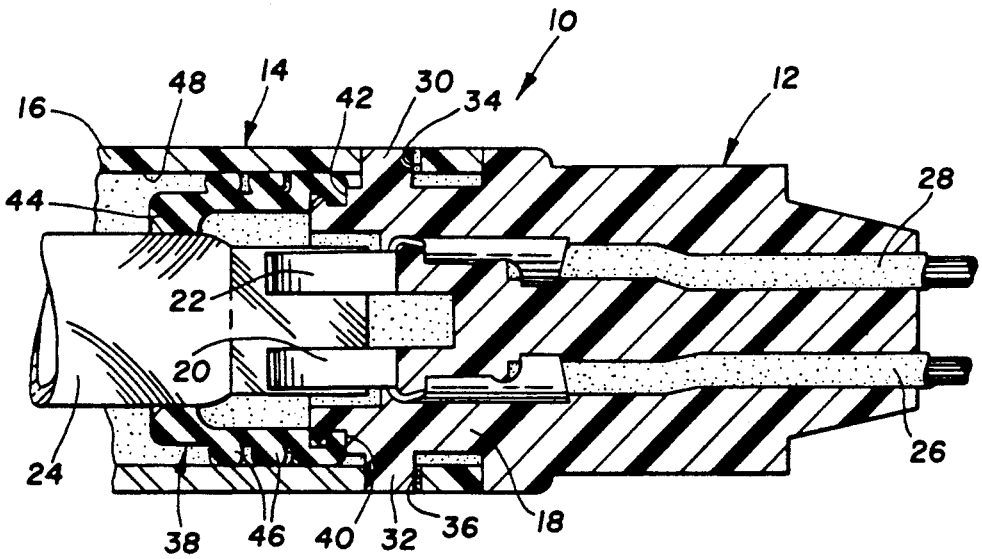
FIG. 2 is an elevational view of the socket member of FIG. 1 located within the socket opening of the lamp housing of FIG. 1 and with all parts except the lamp bulb being shown in section.

Referring now to the drawings and more particularly FIGS. 1 and 2 thereof a lamp assembly 10 according to the invention is shown comprising a lamp socket member 12 and an accommodating lamp housing 14. The lamp assembly can take the form of the lamp assembly seen in Van Duyn et al U.S. Pat. No. 4,477,864 which issued on Oct. 16, 1984 and is assigned to the assignee of this invention. In such lamp assembly the rear of the lamp housing includes the socket opening 16 shown in FIGS. 1 and 2 hereof and would constitute the open end of the body portion of the lamp assembly shown in the Van Duyn et al patent for receiving the lamp socket member 12.

More specifically, the lamp socket member 12 includes a cylindrical body member 18 formed of a plastic material. The front end of the body member 18 has an open end which includes a pair of terminals 20 and 22 that grips the base of a wedge-base type lamp bulb 24 and provides electrical current to the lead wires of the lamp bulb 24. A pair of electrical cables 26 and 28 are connected to the terminals 20 and 22 and are molded within the body member 18. The pair of electrical cables 26 and 28 are connected to a source of electricity for providing electrical current for energizing the lamp bulb 24.

A pair of lugs 30 and 32 are integrally formed with the body member 18 of the socket member 16 and the lugs 30 and 32 form one part of a bayonet-type connection, the other part of which are a pair of identical but reversed in direction diametrically opposed J-slots 34 and 36 formed in the cylindrical wall of the housing 14. Forwardly of the lugs 30 and 32, an elastomeric seal member 38 in the form of a sleeve is carried by the front end of the socket member 12. In this regard, it will be noted that the seal member 38 has a cylindrical main body portion the rear end of which is integrally formed with a radially inwardly extending annular lip 40 which is received by an annular groove 42 formed in the front end of the socket member 12. The forward end of the body portion of the seal member 38 is formed with a radially inwardly extending annular lip 44 which is in sealing contact with the cylindrical portion of the lamp bulb 24. Also, located between the lips 40 and 44 on the exterior of the body portion of the seal member 38 are formed a pair of axially spaced radially outwardly extending annular ribs 46 which provide a seal between the socket member 12 and the inner wall 48 of the socket opening 16. Thus the seal member 38 serves the dual function of sealing the socket opening 16 through the annular ribs 46 and also seals the terminals from the moisture and dirt by having the lip 44 sealingly engaging the lamp bulb 24.

Figure 3:
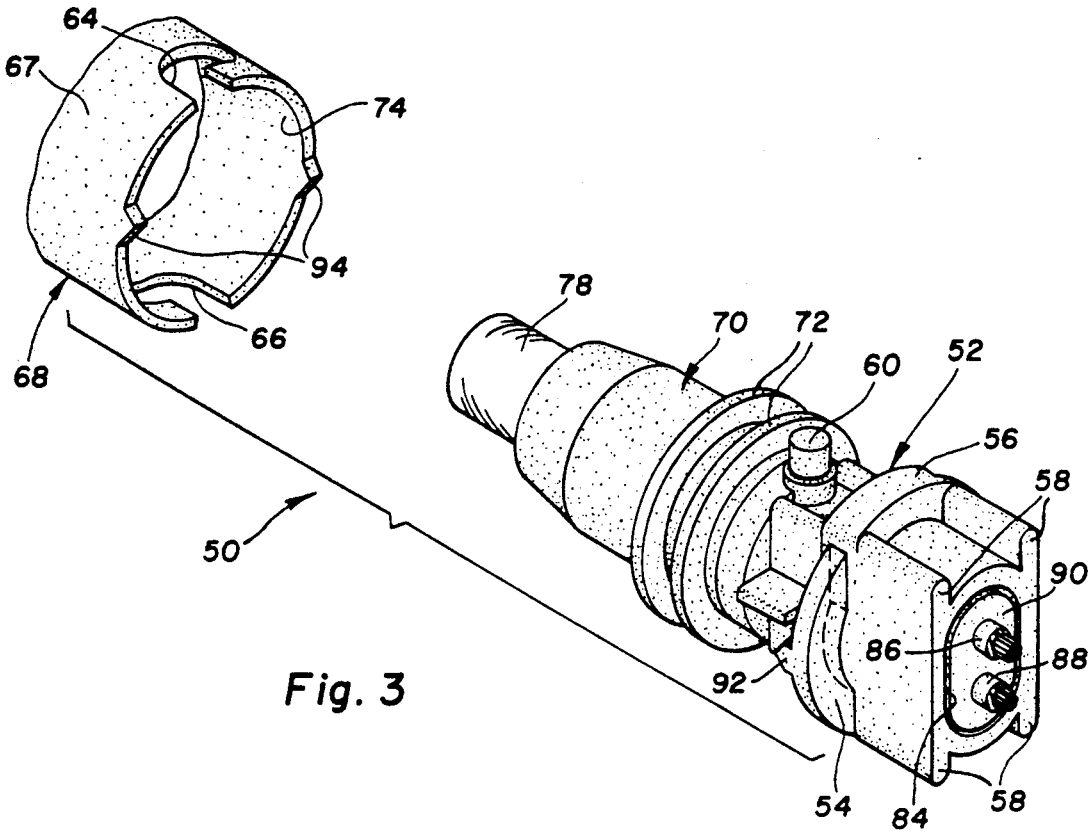
FIG. 3 is a perspective view of a lamp assembly similar to that in FIG. 1 but having a different type of socket member supporting a modified form of a sealing member.
Figure 4:
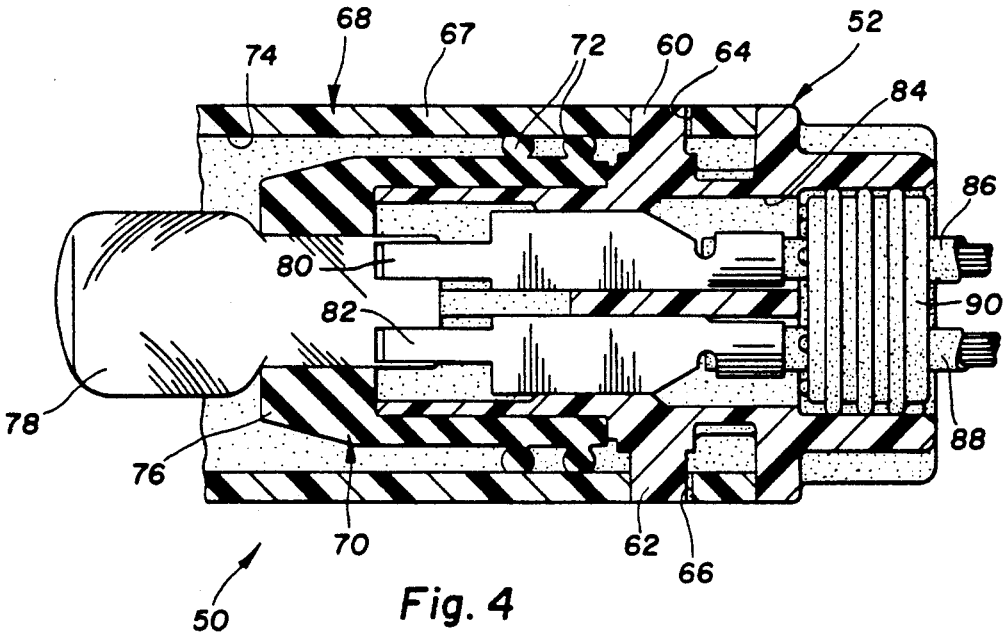
FIG. 4 is an elevational view of the socket member of FIG. 3 located within the socket opening of the lamp housing of FIG. 3 and with all parts except the lamp bulb being shown in section.

A modified form of the present invention can be seen in FIGS. 3 and 4. In this instance, the lamp assembly 50 seen in FIGS. 3 and 4 includes a lamp socket 52 is identical in construction to the lamp socket seen in the aforementioned U.S. Pat. No. 4,758,181. For present purposes, it will suffice to mention that the lamp socket 52 has a cylindrical body member formed with a pair of identical arc-shaped spring arms 54 and 56 each of which is integral at its opposed ends with a longitudinally rearwardly extending ribs 58 which likewise are an integral part of the socket member 52. A pair of identical diametrically opposed cylindrical lugs 60 and 62 are also integrally formed with the socket member 52 and as in the case of the socket member 12 of FIGS. 1 and 2 hereof, the lugs 60 and 62 form one part of a bayonet-type connection the other part of which are a pair of identical but reversed in direction diametrically opposed J-slots 64 and 66 formed in the cylindrical wall 67 of the lamp housing 68. Forwardly of the lugs 60 and 62 a seal member 70 of a sleeve-type configuration is carried by the front end of the socket member 52. In this case, the seal member 70 is also made of an elastomeric material and has its rearward end integrally formed with a pair of axially spaced radially outwardly extending annual ribs 72 which as seen in FIG. 4 sealingly engage the inner surface 74 of the cylindrical wall 67 to seal the socket opening of the socket housing 68. The forward end of the body portion of the seal member 70 is formed with an enlarged radially inwardly extending lip 76 which sealingly engages the lamp bulb 78 carried by the socket member 52. The lamp bulb 78 is gripped by a pair of terminals 80 and 82 located within the receptacle or open end of the socket member 52. The other end of the socket member 52 has a bore 84 formed therein through which extends a pair of electrical cables 86 and 88 which are sealed to the socket member 52 by a multiple cable seal 90. As is conventional, the electrical cables 86 and 88 are connected to the terminals in the socket member 52 for providing electrical current for energizing the lamp bulb 78.

Thus, from the above description, it should be apparent that when the socket member 52 is inserted axially into the socket opening of the housing 68 the lugs 60 and 62 enter the open ends of the J-slots 64 and 66 and the socket member 52 is rotated causing the lock tabs 92 on the spring arms 54 and 56 to ride over similar lock tabs 94 on the housing 68 so that the several parts of the lamp assembly 50 assume the position seen in FIG. 4. At this time the annular ribs 72 seal the socket opening and the lip 76 of the seal member seal the terminals 80 and 82 of the socket member 52 from moisture and dirt.

Various changes and modifications can be made in this construction without departing from the spirit& of this invention. Such changes and modifications are contemplated by the inventor and he does not wish to be limited except by the scope of the appended claims.

The embodiments of the invention in which an exclusive property or privilege is claimed are defined as follows:

1. A lamp assembly including a socket member having an open end removably mountable within the socket opening formed in the rear of a lamp housing, a lamp bulb supported by said open end of said socket member and located within said socket opening of said lamp housing, and an elastomeric seal member carried by said socket member for axial insertion therewith into said socket opening of said lamp housing, said seal member being a single unitary member comprising a cylindrical body portion having the outer surface thereof provided with radially outwardly extending and axially spaced rib means for providing a seal between said socket member and the inner wall in said socket opening when said socket member is inserted into the socket opening and having an annular lip extending radially inwardly therefrom for providing a seal between said lamp bulb and said open end of said socket member.

2. The lamp assembly of claim 1 wherein said body portion has one end thereof sealingly connected to said socket member and has said annular lip located at the other end thereof.

3. The lamp assembly of claim 2 wherein said rib means are located between said one end and said other end of said body portion.

4. The lamp assembly of claim 3 wherein said one end is formed with an annular lip located in an annular groove formed in said socket member.

5. A lamp assembly including a socket member having an open end removably mountable within the socket opening formed in the rear of a lamp housing, a lamp bulb supported by said open end of said socket member and located within said socket opening of said lamp housing, and an elastomeric seal member sealingly carried by said socket member for axial insertion therewith into said socket opening of said lamp housing, said seal member being a single unitary member comprising a sleeve-like body portion having the mid-portion thereof provided with a plurality of annular and axially spaced ribs extending radially outwardly from said body portion for providing a seal between said socket member and the socket opening when said socket member is inserted into the socket opening and having one end thereof provided with a radially inwardly extending annular lip for providing a seal between said lamp bulb and said open end of said socket member.

* * * * *